US009188370B2

(12) United States Patent
Couto et al.

(10) Patent No.: US 9,188,370 B2
(45) Date of Patent: Nov. 17, 2015

(54) MOUNTING ARRANGEMENT FOR AN ECCENTRIC SHAFT IN A REFRIGERATION COMPRESSOR

(75) Inventors: Paulo Rogerio Carrara Couto, Joinville-Se (BR); Ingwald Vollrath, Joinville-Se (BR)

(73) Assignee: Whirlpool S.A., São Paulo -Sp (BR)

( * ) Notice: Subject to any disclaimer, the term of this patent is extended or adjusted under 35 U.S.C. 154(b) by 613 days.

(21) Appl. No.: 13/505,821

(22) PCT Filed: Oct. 29, 2010

(86) PCT No.: PCT/BR2010/000360
§ 371 (c)(1),
(2), (4) Date: Jul. 16, 2012

(87) PCT Pub. No.: WO2011/054067
PCT Pub. Date: May 12, 2011

(65) Prior Publication Data

US 2012/0269662 A1 Oct. 25, 2012

(30) Foreign Application Priority Data

Nov. 3, 2009 (BR) ..... P10905651-3

(51) Int. Cl.
*F25B 1/02* (2006.01)
*F01C 21/02* (2006.01)
(Continued)

(52) U.S. Cl.
CPC . *F25B 1/02* (2013.01); *F01C 21/02* (2013.01); *F04B 27/0404* (2013.01);
(Continued)

(58) Field of Classification Search
CPC ..... F04B 39/023; F04B 35/04; F04B 17/03; F04B 1/00; F04B 25/00; F04B 43/00; F04B 39/04; F04B 29/0042; F04B 29/0078; F04C 29/0042; F04C 29/0078; F04C 29/0057; F04C 2240/601; F04C 2240/80; F04C 2230/604; F04C 18/0207; F01C 21/02; F25B 1/02
USPC ..... 417/415, 410.5, 365, 372, 902, 423.7, 417/423.1, 423.11, 423.12, 410.3; 384/129, 384/226, 275, 295; 310/67 R, 90
See application file for complete search history.

(56) References Cited

U.S. PATENT DOCUMENTS 3,410,478 A * 11/1968 Geisenhaver ..... 417/366
3,454,213 A 7/1969 Valbjorn Knud Vagn
(Continued)

FOREIGN PATENT DOCUMENTS

WO WO-2009114919 A2 9/2009

OTHER PUBLICATIONS

International Search Report, dated May 22, 2012. International Application No. PCT/BR2010/000360.

*Primary Examiner* — Devon Kramer
*Assistant Examiner* — Jon Hoffmann
(74) *Attorney, Agent, or Firm* — Dinsmore & Shohl LLP

(57) ABSTRACT

The compressor of the invention includes a block (B) defining a shaft hub having a first and a second end portion and housing an eccentric shaft having a median portion radially journalled in the shaft hub, and a free end portion carrying the rotor of an electric motor. The first and the second end portions of the shaft hub define radial bearings for the shaft and a support member is formed by a coupling portion, affixed to the free end portion of the shaft, and by a mounting portion, projecting axially and radially from the coupling portion, externally to the shaft hub and around the median portion of the shaft. The rotor is affixed to the mounting portion, concentrically to the eccentric shaft and surrounding the shaft hub.

13 Claims, 5 Drawing Sheets

(51) Int. Cl.

| | |
|---|---|
| ***F04B 27/04*** | (2006.01) |
| ***F04B 39/00*** | (2006.01) |
| ***F04C 29/00*** | (2006.01) |
| *F04C 18/02* | (2006.01) |

(52) U.S. Cl.
CPC ..... *F04B 39/0094* (2013.01); *F04C 29/0042* (2013.01); *F04C 29/0057* (2013.01); *F04C 18/0207* (2013.01); *F04C 2230/604* (2013.01); *F04C 2240/601* (2013.01); *F04C 2240/80* (2013.01)

(56) References Cited

U.S. PATENT DOCUMENTS

| | | | | |
|---|---|---|---|---|
| 3,563,677 | A * | 2/1971 | Retan | 417/415 |
| 4,115,035 | A * | 9/1978 | Tankred et al. | 417/312 |
| 5,322,419 | A * | 6/1994 | Novolan et al. | 417/363 |
| 5,762,164 | A * | 6/1998 | Krueger et al. | 184/6.18 |
| 6,948,418 | B2 * | 9/2005 | Kim | 92/140 |
| 2002/0141892 | A1 | 10/2002 | Takahashi | |
| 2005/0008502 | A1 * | 1/2005 | Manke et al. | 417/313 |
| 2005/0123423 | A1 * | 6/2005 | Weisser | 417/423.7 |
| 2005/0275298 | A1 * | 12/2005 | Iversen et al. | 310/90 |
| 2006/0216166 | A1 * | 9/2006 | Pawellek | 417/371 |
| 2007/0081908 | A1 * | 4/2007 | Nishihara | 417/415 |
| 2007/0166175 | A1 * | 7/2007 | Manke et al. | 417/365 |
| 2007/0241643 | A1 * | 10/2007 | Watanabe et al. | 310/67 R |
| 2009/0185930 | A1 | 7/2009 | Duppert et al. | |

* cited by examiner

MOUNTING ARRANGEMENT FOR AN ECCENTRIC SHAFT IN A REFRIGERATION COMPRESSOR

FIELD OF THE INVENTION

The present invention refers to a constructive arrangement to provide a more effective bearing of an eccentric shaft in the block which carries the compression mechanisms of a refrigeration compressor, whether small, medium or large, either hermetic or not.

PRIOR ART

In some prior art constructive solutions, as illustrated in FIGS. 1 and 2, the mechanical assembly of the refrigeration compressor is basically formed by a block B comprising a shaft hub 10, in the interior of which is radially journalled an eccentric shaft 20, which is rotatively driven by an electric motor of the compressor, for impelling a compression mechanism.

In the prior art compressor construction, the motor 30 generally comprises a stator 31 attached to the block B, and a rotor 32 formed by a core around which are mounted permanent magnets, said rotor being mounted to a free end portion 22 of the eccentric shaft 20 which projects axially outwardly from the shaft hub 10.

In these compressor constructions, the lower end portion of the eccentric shaft 20 generally carries an oil pump 40 for pumping oil from an oil sump, defined in a lower portion of a compressor shell, to the movable parts of the latter to be lubricated.

In large refrigeration compressors, as those of the scroll type (FIG. 2), the eccentric portion 21 of the eccentric shaft 20 drives a compression mechanism in the form of coils 50, mounted against each other and whose relative movement determines the volumes of the compression mechanism.

In reciprocating compressors, the eccentric shaft presents an eccentric portion to which is coupled, generally by a connecting rod, a piston of the compression mechanism and which is housed in the interior of a piston hub of the block. For the constructions of refrigeration compressors with higher capacity or larger sizes (generally for commercial use), the loads received by the eccentric shaft are substantially high and result not only from the compression forces, but mainly, from the loads resulting from the electromagnetic force of the motor, which are particularly relevant upon the motor start, before the beginning of the operation of the compression mechanism.

In a known compression construction, as exemplarily illustrated in FIG. 1, in which the block B is in a single piece, the center of gravity CG of the movable assembly, defined by the eccentric shaft and the rotor, is below the points in which the forces resulting from the compression operation of the compressor are applied.

It should be further noted that, besides the angular deformations, there can also occur manufacturing geometric deviations, which increase the misalignment of the eccentric shaft 20 in relation to the associated elements of the compression mechanism, impairing even more the efficiency and durability of the compressor.

Upon motor start, the electromagnetic force is applied to the rotor-shaft assembly, so as to rotate it in high rotation, in an instant in which the eccentric shaft 20 is stationary, with its radial bearings being free from the load resulting from said electromagnetic force upon energization of the motor. At the motor start, the radial bearings of the eccentric shaft 20 support the whole load of the electromagnetic force applied to the latter. This application of electromagnetic force generates a bending moment on the eccentric shaft 20, which results in a tension force on its structure, tending to cause deformation of said shaft.

There are known some proposals to minimize undesirable deformations in the shaft hub 10 and in the eccentric shaft 20, produced both by the compression load and by the electromagnetic load, at the start of the compressor. A known solution, not illustrated in the drawings, proposes increasing the axial extension of the radial bearing of the eccentric shaft 20, aiming at giving a higher radial support to the latter and to its end portion disposed in cantilever in relation to the shaft hub and in which the electric motor rotor is mounted. However, this solution does not avoid the negative effects regarding the forces resulting from mounting the rotor 32 in an end portion of the eccentric shaft 20, which defines an axial extension in cantilever sufficient for mounting the rotor 32. Other negative aspect of this prior art solution is an undesirable and even unacceptable increase in the compressor height.

Other known solution, also not illustrated, includes the provision of an axial extension of the eccentric shaft, beyond the eccentric portion, for journaling said shaft in a second radial bearing spaced from that or those provided in the interior of the shaft hub. This solution presents some inconveniences, among which the fact that it does not eliminate the bending forces on the eccentric shaft, which still carries the rotor in cantilever in relation to the shaft hub. Other negative aspect of this prior art solution is the fact that it cannot be applied to the scroll-type compressors, since in these compressors the eccentric end portion 21 of the eccentric shaft 20 is mounted internally to the coil assembly.

In order to overcome the problem discussed above, in a compressor which does not permit the bearing to be carried out through the eccentric end portion 21 of the eccentric shaft 20, as it occurs in the scroll-type compressors, it is proposed a solution (FIG. 2) according to which the eccentric shaft is axially extended beyond the rotor mounting portion, so as to be journalled in another radial bearing, also attached to the block B which, in this case, is required to be mandatorily made in two pieces, for allowing mounting the eccentric shaft 20 already containing the rotor 32 attached thereon.

In the constructive solution mentioned above, the electric motor 30 is positioned between two radial bearing regions of the eccentric shaft 20, axially spaced from each other, avoiding the condition of attaching the rotor to an extension of the eccentric shaft 20 which is mounted in cantilever. With the solution provided by the two-piece block B, the center of gravity CG is positioned between the forces which support the eccentric shaft 20, minimizing displacements.

In this solution (FIG. 2), each bearing is provided in a respective block portion. Nevertheless, this construction generates several problems related to project, manufacture and assembly.

In hydrodynamic bearings, parameters such as alignment, concentricity and shaping errors are crucial for the adequate operation of the mechanism. In the solution of the two-piece block, since each bearing is provided in separate components, the mounting of the assembly (eccentric shaft and bearings) is a critical process, requiring each component to present excellent manufacturing quality, precise control in the mounting operations, and resistant constructions, with the purpose of accepting the variables inherent to the process, once the two portions which define the two-piece block are affixed to each other during the mounting of the eccentric shaft 20.

Although providing an adequate bearing for the eccentric shaft and solving the issues regarding the mounting of the motor, the construction in separate pieces and the mounting of said pieces involved in the production of the two-piece block and of the compression assembly generate process complications, since one cannot guarantee the concentricity of the shaft hubs of the two-piece block portions, making critical the alignment of the respective bearings, causing operational problems and consequently compromising the performance, reliability and useful life of the compressor.

FIG. 2 shows each component used for mounting the two-piece block B of the compressor and how this mounting can be carried out. In this construction, block B presents a first block portion B1 and a second block portion B2, generally joined to each other by fixation means, such as screws P. The parts which compound block B form bearings M1, M2 which, jointly with the stator 31, constitute the fixed parts of the assembly. The eccentric shaft 20 and the rotor 32 form the movable assembly.

SUMMARY OF THE INVENTION

In face of the inconveniences of the known constructive solutions, it is a generic object of the present invention to provide a mounting arrangement for an eccentric shaft in a refrigeration compressor of the type discussed above, which allows improving the bearing of the eccentric shaft with the self-aligned mounting of the radial bearings in a single block.

It is another object of the present invention to provide a constructive arrangement of the type mentioned above, which minimizes the deformations resulting from the electromagnetic force and from the compression force on the assembly formed by the eccentric shaft and by the shaft hub.

It is also another object of the present invention to provide an arrangement as cited above, which allows reducing the compressor height.

These and other objects are achieved through a mounting arrangement for an eccentric shaft in a refrigeration compressor of the type which includes a block, comprising a shaft hub having a first and a second end portion and housing an eccentric shaft presenting an eccentric end portion, projecting outwardly from the first end portion of the shaft hub, a median portion radially journalled in the shaft hub, and a free end portion carrying the rotor of an electric motor.

In the arrangement of the present invention, the first and the second end portion of the shaft hub define respective radial bearings for the median portion of the eccentric shaft, there being provided a support member which is formed by a coupling portion affixed to the free end portion of the eccentric shaft, and by a mounting portion which projects axially and radially outwardly from the coupling portion towards the first end portion of the shaft hub, said mounting portion being disposed externally to the shaft hub around the median portion of the eccentric shaft, the rotor being affixed to the mounting portion concentrically to the eccentric shaft and surrounding the shaft hub.

In the proposed solution, the block, by being formed in a single piece, presents the already mentioned advantages related to construction, assembly and alignment of the component parts, carrying two radial bearings axially spaced from each other and around which the electric motor rotor is affixed to the eccentric shaft. Thus, the rotor of the electric motor occupies, in the assembly, a height coincident with that of the shaft hub, reducing the vertical dimension of the compressor and allowing the electromagnetic forces produced by the motor to be applied to the eccentric shaft in a region contained between said radial bearings.

In other words, the construction proposed herein allows, due to the provision of the single block and of the support member: approximating the force-balancing plane to the loading plane; providing two or more radial bearings in a single block; minimizing the mounting steps and possible mounting misalignments; optimizing the height of the assembly; reducing the number of components; and enabling smaller bearing gaps.

BRIEF DESCRIPTION OF THE DRAWINGS

The invention will be described below, with reference to the enclosed drawings, given by way of example and in which.

DETAILED DESCRIPTION OF THE INVENTION

Figure 1:
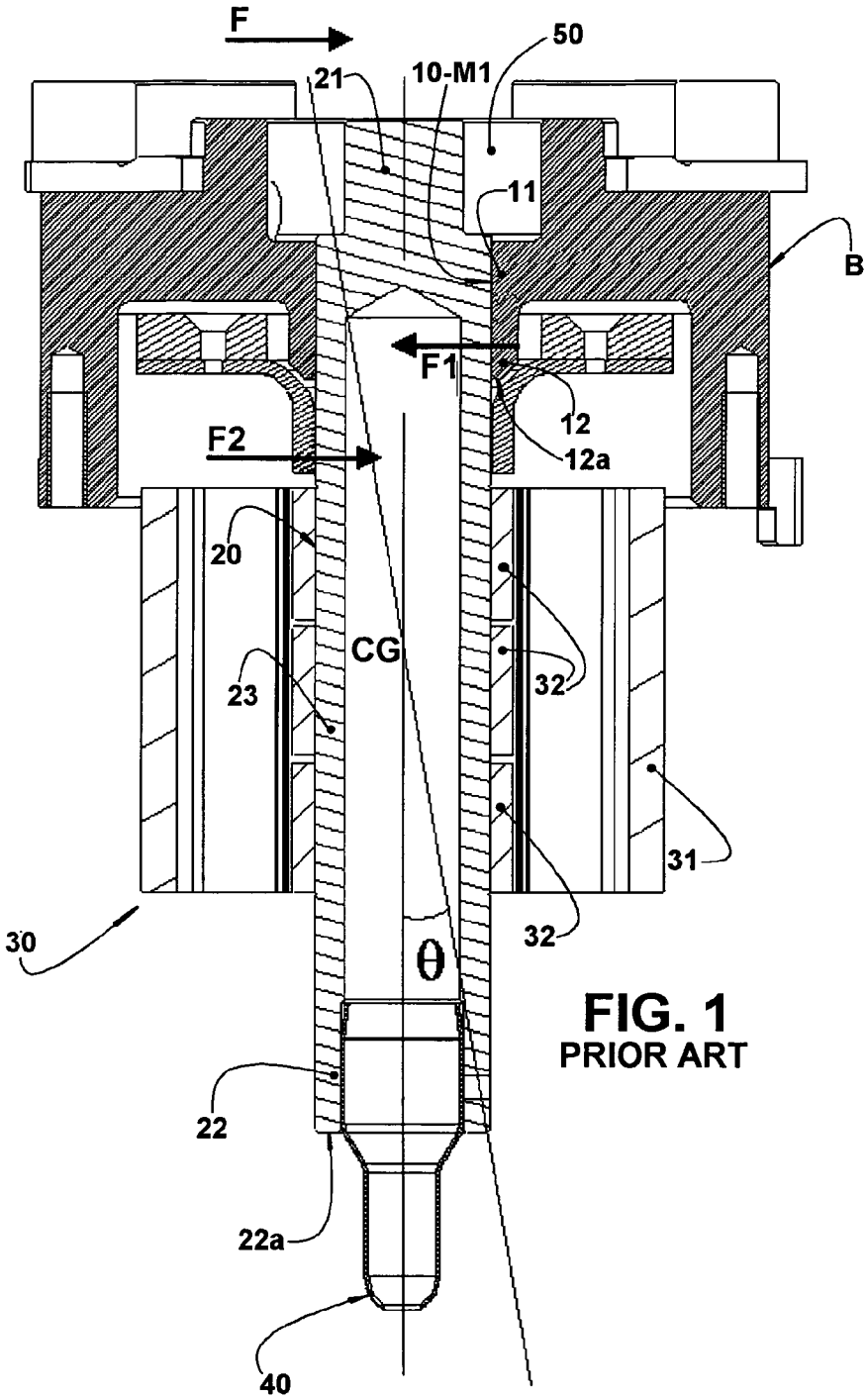
FIG. 1 PRIOR ART
FIG. 1 represents, schematically, a partial longitudinal sectional view of a scroll-type compressor, constructed according to the prior art and having the shaft hub defined in a single-piece block.
Figure 2:
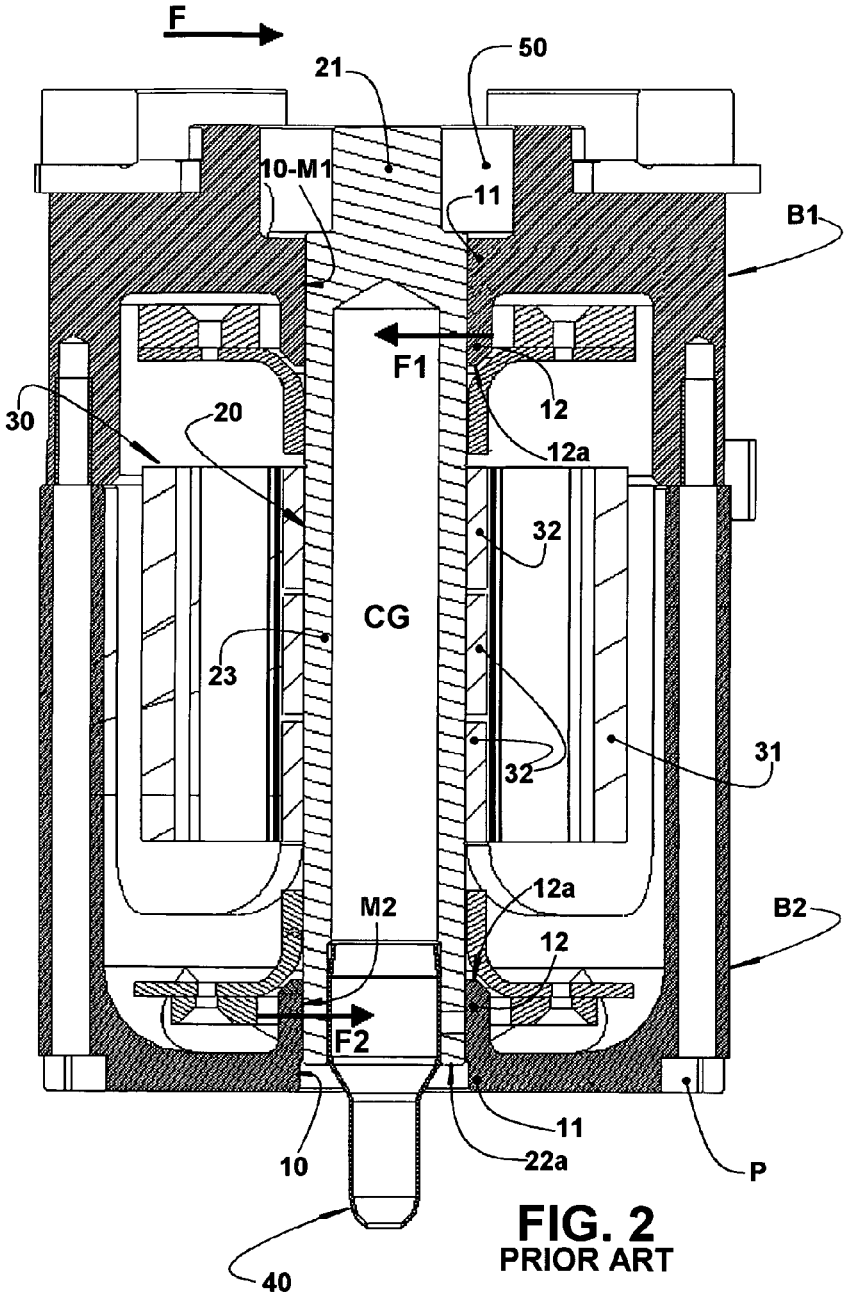
FIG. 2 PRIOR ART
FIG. 2 represents, schematically, a partial longitudinal sectional view of a scroll-type compressor constructed according to the prior art and comprising a two-piece block carrying a pair of radial bearings and an eccentric shaft, in whose median region is mounted an electric motor rotor.

As illustrated, the present invention is applied to a refrigeration compressor, of any size (small, medium or large), either hermetic or not, of the scroll or reciprocating type and which presents, in the interior of a shell (not illustrated), a single block B which comprises, in a single piece, a shaft hub 10 having a first and a second end portion 11, 12, said shaft hub 10 housing an eccentric shaft 20 which incorporates an eccentric end portion 21 projecting outwardly from the first end portion 11 of the shaft hub 10.

The second end portion 12 of the shaft hub 10 presents an annular end face 12*a* which, in some compressor constructions (FIGS. 4 and 5), is coplanar to an end face 22*a* of the free end portion 22 of the eccentric shaft 20.

Figure 3:
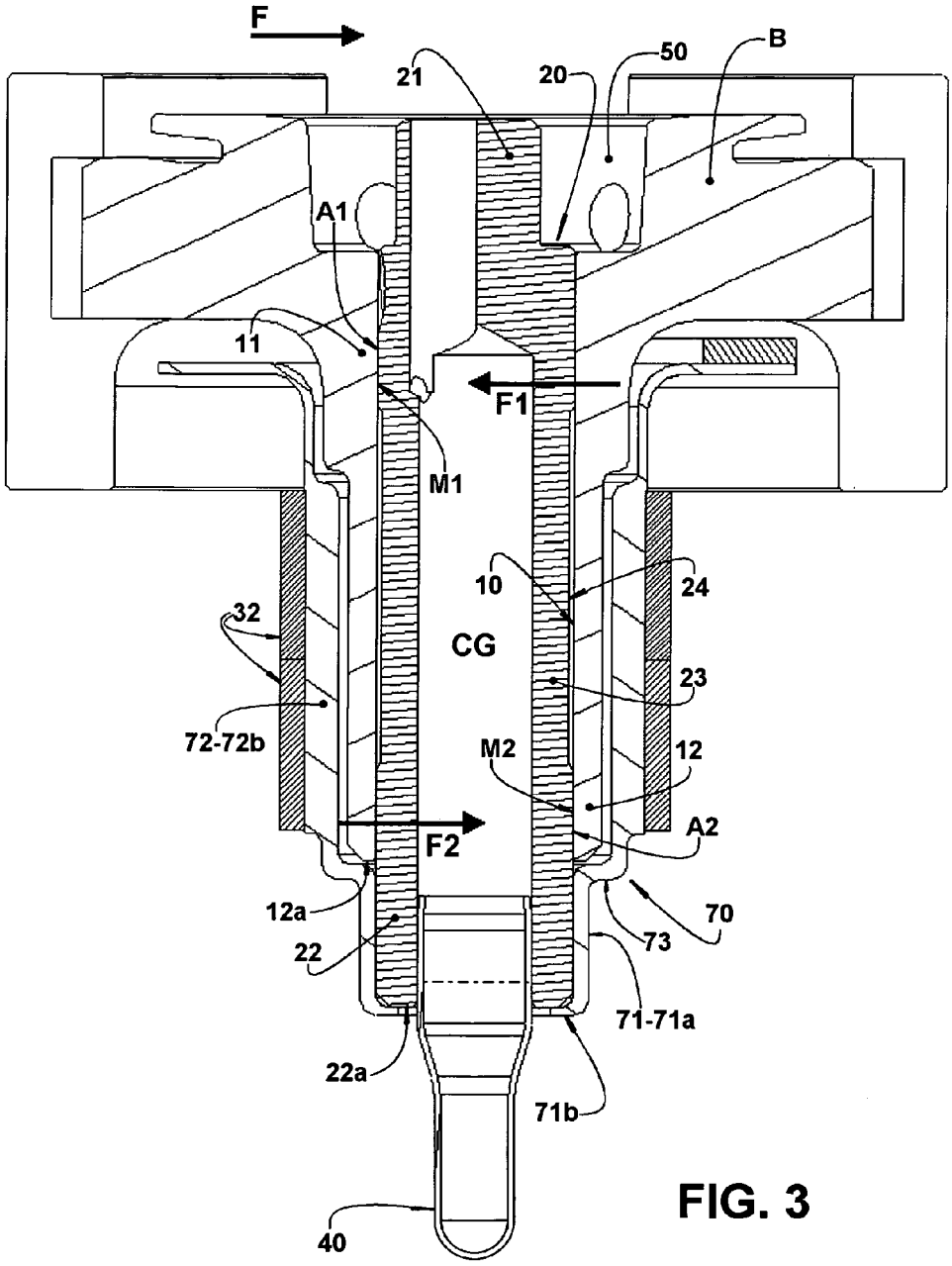
FIG. 3 represents, schematically, a partial longitudinal sectional view of a scroll-type compressor, constructed according to the present invention and comprising a single block which defines a shaft hub provided with two inner radial bearings, in which is journalled an eccentric shaft, having a free end portion in cantilever and carrying the electric motor rotor of the compressor.
Figure 4:
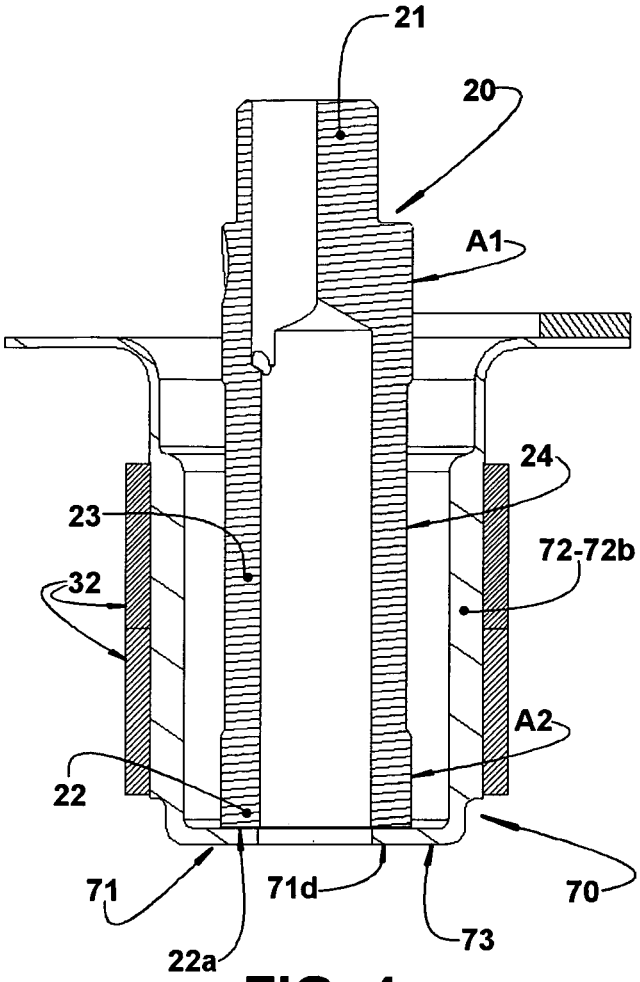
FIG. 4 represents a longitudinal sectional view of part of the assembly illustrated in FIG. 3, but illustrating a constructive variant in which an end face of the free end portion of the eccentric shaft is coplanar to the annular end face of the second end portion of the shaft hub.
Figure 5:
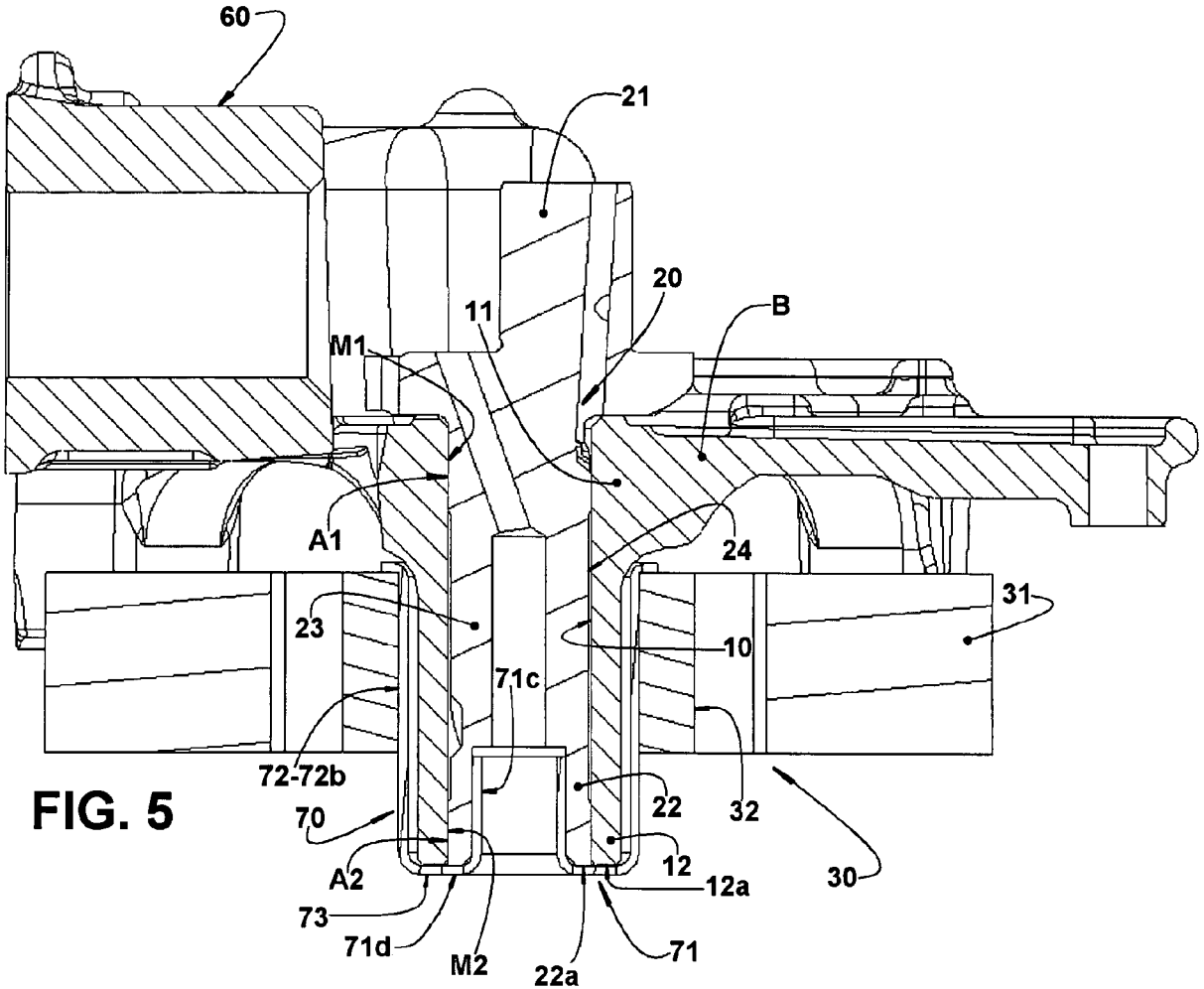
FIG. 5 represents a partial longitudinal sectional view of a reciprocating-type compressor, constructed according to the present invention, comprising a single block which defines a shaft hub provided with two inner radial bearings, in which is seated a tubular eccentric shaft to whose free end portion is attached the electric motor rotor of the compressor, an end face of the free end portion of the eccentric shaft being coplanar to the annular end face of the second end portion of the shaft hub.

As illustrated in FIG. 3, the free end portion 22 of the eccentric shaft 20 projects beyond the annular end face 12*a* of the second end portion 12 of the shaft hub 10, whilst as illustrated in the constructive variants of FIGS. 4 and 5, the end face 22*a* of the free end portion of the eccentric shaft 20 is provided in a plane parallel in relation to the annular end face 12*a* of the second end portion 12 of the shaft hub 10.

Although not illustrated, the present invention can be also applied to the constructions in which the end face 22*a* of the free end portion 22 of the eccentric shaft 20 is provided in a plane spaced back in relation to the annular end face 12*a* of the second end portion 12 of the shaft hub 10.

Said relative positionings permit different constructive arrangements for the present invention, as described ahead.

According to the invention, the eccentric shaft 20 presents its median portion 23 journalled in two radial bearings M1, M2, which are spaced from each other by an axial extension of the eccentric shaft 20, said axial extension being radially spaced back in relation to said radial bearings.

In the illustrated construction, the bearings M1, M2 are defined by respective axial extensions of an inner surface of the shaft hub 10, said axial extensions being respectively defined in the first and in the second end portions 11, 12 of the shaft hub 10.

According to the present invention, the shaft hub 10, formed in a single piece, has the radial bearings M1, M2 actuating against respective annular regions A1, A2 of the median portion 23 of the eccentric shaft 20, axially spaced from each other by a circumferential recess 24, externally provided in the median portion 23 of the eccentric shaft 20. It should be understood that the radial bearings M1, M2 can be spaced from each other by a circumferential recess (not illustrated) provided in the inner surface of the shaft hub 10.

The mounting arrangement of the present invention includes a support member 70, constructed in any material such as, for example, a metallic alloy, which is adequate to support the mechanic forces and the high temperatures to which it is submitted during the operation of the compressor. The support member 70 is formed, preferably in a single piece, by a coupling portion 71, attached to the free end portion 22 of the eccentric shaft 20, and by a mounting portion 72 which projects axially and radially outwardly from the coupling portion 71, towards the first end portion 11 of the shaft hub 10. This construction allows that the mounting portion 72 be disposed externally to the shaft hub 10, around the median portion of the eccentric shaft 20, with the rotor 32 being attached to the mounting portion 72, concentrically to the eccentric shaft 20 and surrounding the shaft hub 10.

The coupling portion 71 and the mounting portion 72 are joined to each other by a generally annular shaped connection portion 73 disposed axially spaced from and in front of the annular end face 12*a* of the second end portion 12 of the shaft hub 10, maintaining with said annular end face 12*a* a short spacing, sufficient to avoid contact between the shaft hub 10, which is stationary, and the support member 70 which rotates with the eccentric shaft 20.

In the type of mounting arrangement illustrated in FIG. 3 of the enclosed drawings, the free end portion 22 of the eccentric shaft 20 projects axially outwardly from the second end portion 12 of the shaft hub 10. In this case, the support member 70 has its coupling portion 72 mounted and retained around said free end portion 22 of the eccentric shaft 20.

In the constructive form illustrated in FIG. 3, the coupling portion 71 takes the form of a cylindrical sleeve 71*a* surrounding, with interference, the free end portion 22 of the eccentric shaft 20 which projects outwardly from the second end portion 12 of the shaft hub 10. On the other hand, the mounting portion 72 is defined by a cylindrical tubular body 72*b*, radially spaced from the shaft hub 10 and in whose outer lateral face is attached the rotor 32 of the electric motor 30. Generally, the rotor 32 comprises permanent magnets which are affixed externally to the mounting portion 72 of the support member 70.

Although the support member 70 is illustrated in FIGS. 3, 4 and 5, formed in a single piece, with the coupling portion 71 and mounting portion 72 in the form of cylindrical tubular bodies, it should be understood that the support member 70 can be formed by different structural frames, which allow for the reliable and correct fixation of the rotor 32 to the free end portion 22 of the eccentric shaft 20.

As illustrated in FIG. 3, the coupling portion 71, in the form of a cylindrical sleeve 71*a*, of the support member 70, can incorporate, in a single piece, a generally annular end portion 71*b* which is seated and optionally affixed against the end face 22*a* of the free end portion 22 of the eccentric shaft 20.

With the provision of the support member 70, the rotor 32 of the electric motor can be attached to the eccentric shaft 20, without requiring the latter to project, in cantilever, outwardly from the shaft hub 10, throughout an extension which corresponds to the height of the rotor 32. The rotor 32 can be positioned around both the shaft hub 10 and the median portion of the eccentric shaft 20 which is journalled in the interior of said shaft hub 10. Although the free end portion 22 of the eccentric shaft is illustrated in the tubular shape, it should be understood that this shape may be massive, in which case the end face 22*a* may not present an annular configuration, assuming a circular form.

As illustrated in FIG. 3, the coupling portion 72, in the form of cylindrical sleeve 71*a*, can incorporate an annular-shaped end portion 72*b* to be seated and optionally affixed in the also annular end face 22*a* of the second end portion 12 of the shaft hub 10.

It should be understood that, when the eccentric shaft 20 is provided with the free end portion 22 in a cylindrical tubular shape, with its end face 22*a* presenting an annular shape, the end portion 71*b* of the coupling portion 71, to be seated against the annular end face 12*a* of the free end portion 12 of the eccentric shaft 12, can incorporate a tubular projection 71*c* which is fitted and optionally affixed in the interior of the cylindrical tubular free end portion 22 of the eccentric shaft 20. The tubular projection 71*c* is illustrated in the embodiment of FIG. 5, but it can be also applied to the constructions which present an eccentric shaft 20 with a free end portion 22 of cylindrical tubular shape, as illustrated in FIGS. 3 and 4. In this case, the fixation of the support member 70 to the eccentric shaft 20 is achieved by affixing at least one of the parts defined by the coupling portion 71, by the end portion 71*b* and by the tubular projection 71*c* to the free end portion 22 of the eccentric shaft 20. The fixation can be made by different adequate means as, for example, welding, gluing, screws, rivets, etc.

FIGS. 4 and 5 illustrate constructions in which the free end portion 22 of the eccentric shaft 20 presents an end face 22*a* spaced from or coplanar to the annular end face 12*a* of the second end portion 12 of the shaft hub 10. In this case, any oscillation of the eccentric shaft 20 is suppressed, allowing the height of the block-shaft-motor assembly to be even more reduced.

In the construction illustrated in FIGS. 4 and 5, the coupling portion 71 takes the form of a radially inner annular extension 71*d* of the connection portion 73, said annular extension 71*d* being seated and affixed against the annular end face 12*a* of the second end portion 12 of the shaft hub 10. In the case, not illustrated, in which the end face 22*a* of the free end portion 22 of the eccentric shaft 20 is axially spaced back in relation to the annular end face 12*a* of the second end portion 12 of the shaft hub 10, the annular extension 71*d* is configured to be seated and attached against said annular end face 12*a* of the second end portion 12 of the shaft hub 10.

As illustrated in FIG. 5, in which the free end portion of the eccentric shaft 20 presents a cylindrical tubular shape and its end face 22*a* has an annular configuration, the coupling portion 71 in the form of an annular extension 71*d* of the connection portion 73 can further present a tubular projection 71*c*, as already previously mentioned, which is fitted and optionally attached in the interior of the cylindrical tubular free end portion 22 of the eccentric shaft 20.

In the solution of the present invention, the provision of the support member 70 and of the single-piece block B carrying two radial bearings M1, M2 to actuate against respective annular regions A1, A2 of the median portion 23 of the eccentric shaft 20, allows minimizing or even eliminating the existence of a cantilevered portion of the eccentric shaft for carrying the rotor 32 of the electric motor. By mounting the rotor 32 with its axial extension completely disposed around the portion of the shaft hub 10 and around the radially supported median portion 23 of the eccentric shaft 20, it is possible to reduce the deforming forces on the eccentric shaft 20 and on the shaft hub 10, as well as the height of the compressor.

The solution proposed herein eliminates the need to increase the axial extension of the bearing region of the eccentric shaft 20, avoiding higher power consumption, by viscous friction, in the radial support of the eccentric shaft.

In the solution of the present invention, the rotor 32, with the permanent magnets, has its axial extension completely disposed around the single-piece block B. This construction allows obtaining a disposition of forces and a positioning of center of gravity CG similar to those obtained with the formation of the two-piece block B, without the inconveniences presented by the known two-piece block construction in terms of manufacture and assembly of the compressor.

The proposed concept can be employed for compressors with two-piece bearings and compressors with a single block, bringing benefits for both constructions.

With the arrangement of the present invention, it is possible to obtain an adequate centralization of the motor, dispensing the need of using an eccentric shaft or a too long block. Moreover, the eccentric shaft is journalled in two bearings in a single block, which two bearings are necessary for large refrigeration compressors in which the load on the eccentric shaft is too high. With the present invention, the rotor is no longer mounted in a cantilevered portion of the eccentric shaft, but between two bearing regions in the shaft hub, whereby the shaft is no longer submitted to the bending moment loads resulting from the electromotive force upon the start of the compressor.

The present solution, when applied to a reciprocating compressor, allows the rotor to be positioned closer to the first end portion 11 of the shaft hub 10 of the block B, thus reducing the dimensions of the compressor, for any of the known compressor constructions having an eccentric shaft. Besides the considerable gain in the compressor size, the present solution also allows reducing the amount of material.

In any of the constructions discussed herein, the support member 70 can be provided incorporating an oil pump 40, for example by stamping, when said support member 70 is made of metallic material.

The invention claimed is:

1. A mounting arrangement for an eccentric shaft in a refrigeration compressor, the mounting arrangement comprising: a block (B) and a shaft hub, the block (B) and the shaft hub being one continuous piece, the shaft hub having a first and a second end portion and housing the eccentric shaft which presents an eccentric end portion projecting outwardly from the first end portion of the shaft hub, a median portion radially journalled in the shaft hub, and a free end portion carrying a rotor of an electric motor, said arrangement being characterized in that the first and the second end portions of the shaft hub define respective radial bearings for the median portion of the eccentric shaft, there being provided a support member which is formed by a coupling portion, affixed to the free end portion of the eccentric shaft, and by a mounting portion projecting axially and radially outwardly from the coupling portion towards the first end portion of the shaft hub, said mounting portion being disposed externally to the shaft hub around the median portion of the eccentric shaft, the rotor being affixed to the mounting portion, concentrically to the eccentric shaft and surrounding the shaft hub.

2. The mounting arrangement, as set forth in claim 1, in which the second end portion of the shaft hub presents an annular end face and the free end portion of the eccentric shaft projects axially outwardly from the second end portion of the shaft hub and presents an end face, the arrangement being characterized in that the coupling portion is mounted and retained around said free end portion of the eccentric shaft.

3. The mounting arrangement, as set forth in claim 2, characterized in that the coupling portion takes the form of a cylindrical sleeve surrounding the free end portion of the eccentric shaft.

4. The mounting arrangement, as set forth in claim 2, characterized in that the coupling portion incorporates an end portion seated against the end face of the free end portion of the eccentric shaft.

5. The mounting arrangement, as set forth in claim 3, in which a free end portion of the eccentric shaft presents a cylindrical tubular shape with its end face presenting an annular shape, the arrangement being characterized in that the end portion of the coupling portion presents an annular shape and is seated against the end face of the free end portion of the eccentric shaft, said end portion incorporating a tubular projection fitted in the interior of the free end portion of the eccentric shaft.

6. The mounting arrangement, as set forth in claim 5, characterized in that at least one of the parts defined by the coupling portion, by the end portion and by the tubular projection, is affixed to the free end portion of the eccentric shaft.

7. The mounting arrangement, as set forth in claim 1, in which the second end portion of the shaft hub presents an annular end face and the free end portion of the eccentric shaft presents an end face spaced back or coplanar in relation to said annular end face of the second end portion of the shaft hub, the arrangement being characterized in that the coupling portion is seated and attached against the end face of the free end portion of the eccentric shaft.

8. The mounting arrangement, as set forth in claim 7, in which the free end portion of the eccentric shaft presents a cylindrical tubular shape with its end face presenting an annular shape, the arrangement being characterized in that the coupling portion is defined by an annular extension seated against the end face of the free end portion of the eccentric shaft and incorporating a tubular projection fitted in the interior of the free end portion of the eccentric shaft.

9. The mounting arrangement, as set forth in claim 8, characterized in that at least one of the parts defined by the annular extension and by the tubular projection of the coupling portion is affixed to the free end portion of the eccentric shaft.

10. The mounting arrangement, as set forth in claim 2, characterized in that the mounting portion is attached to the coupling portion by means of a connection portion disposed axially spaced from and in front of the annular end face of the second end portion of the shaft hub.

11. The mounting arrangement, as set forth in claim 1, characterized in that the mounting portion is defined by a cylindrical tubular body radially spaced from the shaft hub and to whose outer lateral face is attached the rotor of the electric motor.

12. The mounting arrangement, as set forth in claim 1, characterized in that the shaft hub is formed in a single piece, having the radial bearings (M1,M2) axially spaced from each other by an extension of the eccentric shaft that is radially spaced back in relation to said radial bearings.

13. The mounting arrangement, as set forth in claim 8, characterized in that the two radial bearings (M1, M2) are defined by respective axial extensions of an inner surface of the shaft hub, said axial extensions being respectively defined in the first and in the second end portions of the shaft hub, said radial bearings (M1,M2) actuating against respective annular regions (A1,A2) of the median portion of the eccentric shaft that are axially spaced from each other by a circumferential recess externally provided in the median portion of the eccentric shaft.

* * * * *